US008213647B2

(12) United States Patent
van der Bilt et al.

(10) Patent No.: US 8,213,647 B2
(45) Date of Patent: Jul. 3, 2012

(54) ELECTROACOUSTIC DEVICE

(75) Inventors: Casper van der Bilt, Emmen (NL); Gerjo Sampimon, Erm (NL); Angelique Hofstede, Emmen (NL); Hedzer van der Kamp, Emmen (NL)

(73) Assignee: Sony Ericsson Mobile Communications AB, Lund (SE)

( * ) Notice: Subject to any disclaimer, the term of this patent is extended or adjusted under 35 U.S.C. 154(b) by 1054 days.

(21) Appl. No.: 11/909,113

(22) PCT Filed: Mar. 20, 2006

(86) PCT No.: PCT/EP2006/002820

§ 371 (c)(1),
(2), (4) Date: Jun. 12, 2008

(87) PCT Pub. No.: WO2006/100104

PCT Pub. Date: Sep. 28, 2006

(65) Prior Publication Data

US 2008/0285786 A1 Nov. 20, 2008

Related U.S. Application Data

(60) Provisional application No. 60/666,284, filed on Mar. 29, 2005.

(30) Foreign Application Priority Data

Mar. 22, 2005 (EP) ..... 05388026

(51) Int. Cl.
*H04R 5/02* (2006.01)

(52) U.S. Cl. ..... 381/304; 381/330; 381/361; 381/364; 381/379

(58) Field of Classification Search ..... 381/304, 381/330, 361, 364, 379
See application file for complete search history.

(56) References Cited

U.S. PATENT DOCUMENTS

| | | | | | |
|---|---|---|---|---|---|
| 1,513,924 | A | * | 11/1924 | Murdock | 381/379 |
| 2,474,386 | A | * | 6/1949 | Volkmann | 381/378 |
| 3,263,032 | A | * | 7/1966 | Scanlon | 381/379 |
| 3,430,261 | A | * | 3/1969 | Benner | 2/423 |
| 3,588,384 | A | * | 6/1971 | Negley | 381/375 |
| 4,404,434 | A | * | 9/1983 | Pelt et al. | 381/383 |
| 5,293,647 | A | * | 3/1994 | Mirmilshteyn et al. | 2/209 |
| 5,335,285 | A | | 8/1994 | Gluz | 381/187 |

(Continued)

OTHER PUBLICATIONS

International Preliminary Report on Patentability for PCT/EP2006/002820 dated Mar. 16, 2007.

*Primary Examiner* — David S. Warren
(74) *Attorney, Agent, or Firm* — Myers Bigel Sibley & Sajovec

(57) ABSTRACT

An electroacoustic device includes a rear body portion containing electronic circuits, being so dimensioned and shaped as to be carried by a human user behind the user's ear and having an upper end portion and a frontal body portion with an upper end portion connected to the upper end portion of the rear body portion. The device may include an electroacoustic speaker transducer connected to the frontal body portion and arrangeable in a sound transmitting relationship to the user's ear canal when the device is carried by the human user. The speaker transducer may be rotatable about an axis which is arranged on a plane that is substantially parallel to the side of the head of the user when the device is carried by the human user.

11 Claims, 1 Drawing Sheet

U.S. PATENT DOCUMENTS

| | | | | |
|---|---|---|---|---|
| 5,655,026 | A * | 8/1997 | Peters et al. | 381/385 |
| 5,708,724 | A | 1/1998 | Burris et al. | 381/183 |
| 5,729,615 | A * | 3/1998 | Yang | 381/370 |
| 5,761,298 | A | 6/1998 | Davis et al. | 379/430 |
| 6,047,076 | A * | 4/2000 | Yang | 381/381 |
| 6,097,827 | A * | 8/2000 | Yang | 381/375 |
| 6,490,362 | B1 * | 12/2002 | Clegg et al. | 381/375 |
| 6,584,208 | B2 * | 6/2003 | Cheng | 381/381 |
| 6,721,433 | B2 * | 4/2004 | Sato | 381/379 |
| 6,744,898 | B1 * | 6/2004 | Hirano | 381/333 |
| 7,082,207 | B2 * | 7/2006 | Rapps | 381/381 |
| 7,245,737 | B2 * | 7/2007 | Amae et al. | 381/374 |
| 7,283,641 | B2 * | 10/2007 | Rolla | 381/376 |
| 7,356,156 | B2 * | 4/2008 | Regg | 381/379 |
| 7,457,428 | B2 * | 11/2008 | Vaudrey et al. | 381/372 |
| 7,613,292 | B2 * | 11/2009 | te Riet | 379/430 |
| 7,682,018 | B2 * | 3/2010 | Jannard | 351/158 |
| 7,747,003 | B2 * | 6/2010 | Regen et al. | 379/430 |
| 2002/0039427 | A1 * | 4/2002 | Whitwell et al. | 381/312 |
| 2002/0041697 | A1 * | 4/2002 | MacDonald et al. | 381/381 |
| 2002/0080989 | A1 * | 6/2002 | Chi-Lin | 381/374 |
| 2002/0168081 | A1 * | 11/2002 | Sato | 381/379 |
| 2004/0066948 | A1 * | 4/2004 | Bogeskov-Jensen | 381/376 |
| 2004/0096075 | A1 | 5/2004 | Kuhlmann et al. | 381/312 |
| 2004/0105566 | A1 * | 6/2004 | Matsunaga et al. | 381/381 |
| 2004/0190745 | A1 * | 9/2004 | Chen | 381/381 |
| 2006/0140435 | A1 * | 6/2006 | Sheehy et al. | 381/390 |
| 2007/0201000 | A1 * | 8/2007 | Jackson et al. | 351/158 |
| 2008/0260196 | A1 * | 10/2008 | Tsai | 381/380 |
| 2008/0285786 | A1 * | 11/2008 | van der Bilt et al. | 381/381 |
| 2009/0003638 | A1 * | 1/2009 | Fischer | 381/330 |
| 2010/0238396 | A1 * | 9/2010 | Jannard | 351/158 |

* cited by examiner

ELECTROACOUSTIC DEVICE

RELATED APPLICATIONS

The present application is a 35 U.S.C. §371 national phase application of PCT International Application No. PCT/EP2006/002820, having an international filing date of Mar. 20, 2006 and claiming priority to European Patent Application No. 05388026.6 filed Mar. 22, 2005 and U.S. Provisional Application No. 60/666,284 filed Mar. 29, 2005, the disclosures of which are incorporated herein by reference in their entireties. The above PCT International Application was published in the English language and has International Publication No. WO 2006/100104.

FIELD OF THE INVENTION

This invention relates to electroacoustic devices having an electroacoustic speaker transducer and which can be carried by a human user where the device is placed in a position where it sits on the user's ear. Such electroacoustic devices comprise a rear body portion containing electronic circuits, being so dimensioned and shaped as to be carried by a human user behind the user's ear and having an upper end portion, a frontal body portion with an upper end portion connected to the upper end portion of the rear body portion, and an electroacoustic speaker transducer connected to the frontal body portion and arrangeable in a sound transmitting relationship to the user's ear canal, Sound emitted from the speaker transducer can be received in the ear canal and perceived by the user. Such devices are suitable for use as over-the-ear (OTE) headsets for providing wired or wireless communication with e.g. a mobile telephone.

BACKGROUND OF THE INVENTION

The speaker transducer should fit to the user's ear and be in a sound transmitting relationship to the user's ear canal as prescribed by the manufacturer in order to deliver a sound quality as expected and within the specifications.

Simple OTE headsets exist that have a simple ergonomic structure without any possibility of adapting the headset to the anatomy of the user's ear. Such headsets have a reasonably good fit to only relatively few users' ears, if any, and a fit which is not optimal to a large number of users' ears. This results in large variations in the objective (i.e. measurable) sound quality and in the subjective (i.e. perceived) sound quality.

More complex OTE headsets exist that have several possibilities of adjustment to the anatomy of the user's ear. Some are very complex and require adjustments each time the user puts on the headset. A good example of such a headset is shown in U.S. Pat. No. 5,761,298.

It is therefore the object of the invention to provide an over-the-ear headset which is simple to use and which can be adjusted to fit practically all users' ears, left and right ears alike, and deliver good sound quality to all users.

SUMMARY OF THE INVENTION

This objective is achieved with an electroacoustic device as mentioned in the opening paragraph in which, according to the invention, the speaker transducer is rotatable about an axis which is arranged on a plane which is essentially parallel to the side of the head of the user when the device is carried by the human user.

Such a device allows the user to adjust the position of the speaker transducer to fit the individual anatomy of his/her ears and to fit to the actual need. Thus, e.g. in noisy environments the user can move the transducer closer to the entrance of the ear canal to better exclude noise from the environments and to increase the sound level from the transducer received in the ear canal, and when it is desired to perform conversation with other people, the transducer can be moved away from the entrance to the ear canal.

Furthermore, such a device allows the speaker to be brought very close to the user's ear canal. In this way, much lower sound levels can be used. In addition, in the case that the device includes a microphone, the lower sound output levels of the speaker, allow the microphone to be placed closer to the speaker without the risk of echoes. The lower sound levels output by the speaker also ensure that the sound output to the environment is reduced. In this way, it is ensured that the sound output from the speaker does not disturb and is not heard by other people in the vicinity of the user. The current geometry also allows the use of a small speaker which helps in reducing the size of the device.

In one embodiment of the device, the axis could form an angle to a horizontal plane of between +50° and −50°, preferably between +30° and −30°, and most preferably between +15° and −15°. By rotating about an axis with a horizontal component, the vertical position of the speaker relative to the users ear canal can be adjusted. In a preferred embodiment, the axis is essentially horizontal.

The position of the speaker transducer in the forward-backward direction could also be adjustable. This will allow the speakers position to be adjusted to account for users having different ear widths.

The speaker transducer could also be rotatable about an axis which is essentially perpendicular to a plane which is essentially parallel to the side of the head of the user when the device is mounted on the user.

The electroacoustic device could further comprise a resilient element which biases the speaker transducer towards a preferred position. For example, the speaker could be biased forwards, thereby pushing the speaker transducer against the user's ear canal.

The frontal body portion could comprise movably interconnected rigid parts whereby the position of the speaker transducer relative to the upper end portion of the frontal body portion can be adjustable.

The movably interconnected rigid parts could comprise a rotatable joint connection, and the movably interconnected rigid parts comprise a sliding connection allowing the rigid parts to slide along each other.

Using various joints and moving parts, the speaker transducer can have up to six degrees of freedom, where its vertical position, its position in the forward-backward direction, its position in the lateral direction, its angular position about a vertical axis, its angular position about a lateral (left-right) axis and its angular position about a front-rear axis are individually adjustable.

The device may further comprise a microphone. The microphone can be arranged at a free end of an elongate member that is moveable between a forwardly extended position and a retracted position. In the forwardly extended position the microphone could be arranged closer to the mouth of a user than when the microphone is in its retracted position where it could be farther from the mouth of the user.

Preferably, the device is symmetrically adjustable relative to a median plane of the device so as to be equally suitable for the user's left and right ears.

The device may further comprise means for wireless communication, such as in accordance with the Bluetooth protocol.

Please note that any terms of orientation in this specification refer to the orientation of the headset as shown in the figures. For example, the term "horizontal" is not well defined when the headset sits on the user's ear since the user can wear the headset in many different orientations. However, the term horizontal when used in this specification refers to the orientation shown in the figures.

DETAILED DESCRIPTION OF THE INVENTION

Figure 1:
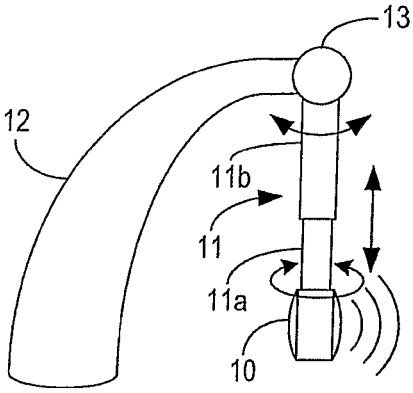
FIG. 1 is a right side view of a first embodiment of an OTE headset.

FIG. 1 shows an over-the-ear wireless headset with an electroacoustic speaker transducer 10 carried at the free end of a frontal body portion 11. The frontal body portion has an upper end portion (11*b*). The device also has a rear body portion 12 with an upper end portion connected to the upper end portion of the frontal body portion at a joint 13 such as a knee joint or a ball joint. The rear body portion 12 contains all the electronic components, circuits and controls which are necessary for the operation of the headset and for its wireless communication, e.g. using the Bluetooth protocol. The headset is so dimensioned and shaped as to be carried by a human user with the headset "riding" on the ear so that the rear body portion 12 is behind the user's ear and the frontal body portion in front of the ear with the electroacoustic speaker transducer 10 in a sound transmitting relationship to the user's ear, where sound from the speaker transducer 10 reaches the ear canal of the user.

The speaker transducer 10 is carried on the free end of a first rod 11*a* of the frontal body portion 11, which is movably received in a second rod 11*b*, so that the transducer can move up and down relative to the joint 13 to accommodate for individual variations in size of the users' ears, and in particular the variations in the distance of the entrance of the ear canal below the upper portion of the root of the ear.

The joint 13 makes it possible to move the entire frontal body portion 11 with the speaker transducer 10 in a rotating movement around the joint 13 and thus to position the transducer in a desired position in the rear-front position.

FIG. 1 also shows that the transducer 10 can be rotated about an axis through the frontal body portion 11, i.e. a vertical axis. This further enhances the possibilities of adapting the headset to the user's ear and to the actual needs of the user.

Figure 2:
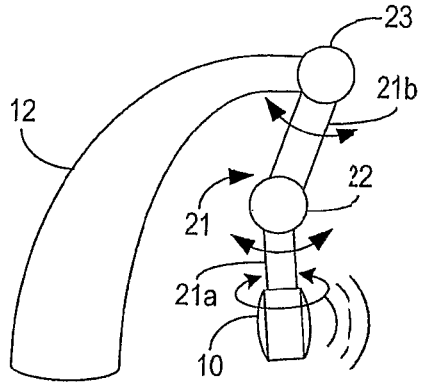
FIG. 2 is a right side view of a second embodiment of an OTE headset.

FIG. 2 shows a second embodiment of a headset. The second embodiment of a headset has a rear body portion 12 which is similar to the rear body portion of the first embodiment and a frontal body portion 21. The frontal body portion comprises a lower rigid part 21*a* and an upper rigid part 21*b*. The two rigid parts are connected with a rotatable joint 22. In the current embodiment, the joint 22 allows rotation about an axis which is perpendicular to a plane which is parallel to the side of the user's head when the device is mounted on the user. The joint is similar to a knee joint. However, other forms of joint such as a ball joint could also be used. The upper rigid part 12*b* is connected to an upper portion of the rear body portion 12 via a second rotatable joint 23. The second rotatable joint 23 could be similar to the joint 13 described in the first embodiment. The speaker transducer 10 is mounted at the lower portion of the lower rigid part 21*a*. Furthermore, as the figure shows, the speaker transducer 10 can be rotated about the longitudinal axis of the lower rigid part 21*a*.

Figure 3:
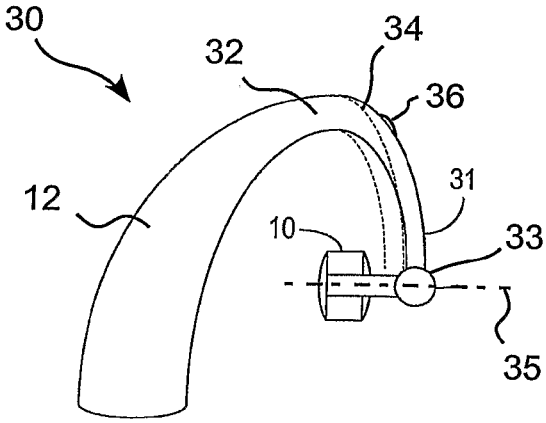
FIG. 3 is a right side view of a first embodiment of an OTE headset according to the current invention.
Figure 4:
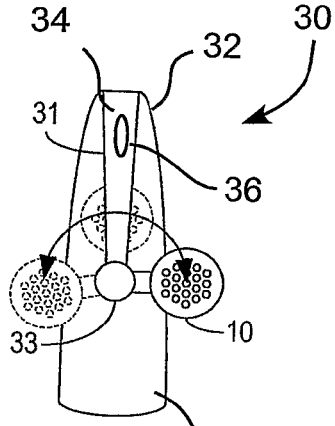
FIG. 4 is a front view of the embodiment in FIG. 3.

FIGS. 3 and 4 show a first embodiment 30 of an electroacoustic device according to the current invention. As with the previous two embodiments, this embodiment is also an over the ear headset (OTE) and comprises a rear body portion 12 comprising the necessary electronics, a frontal body portion 31, a speaker transducer and a microphone. An upper part 34 of the frontal body portion 31 is connected to the rear body portion 12 at an upper end 32 thereof.

The speaker transducer 10 is mounted on a joint 33 at the lower end of the frontal body portion 31. The speaker transducer is connected to the frontal body portion at a position which would be in the vicinity of the user's ear canal when the electroacoustic device is mounted on the user's ear. As can be seen from the figure, the speaker transducer is arranged in such a way that the sound is directed in a forward direction. Due to the sound being directed forwards, the sound emitted from the speaker, bounces against the entrance to the ear canal of the user and thereafter enters the ear canal. In this way, the distance traveled by the sound before it reaches the ear of the user is very short. This allows the use of lower sound pressure from the speaker and therefore less sound is radiated to the environment. This prevents other people from listening to the conversation. Note that in the current embodiment, the sound is directed directly forwards, however other directions of sound having a forwards component would also be acceptable.

The joint 33 is arranged such that the speaker transducer can rotate about an axis 35 which is arranged on a plane which is parallel to the side of the user's head when the device is being carried by the user. In the current embodiment, the axis is essentially horizontal. In this way, the speaker transducer 10 can be moved to either side of the device in order to assume left and right positions. In addition, the speaker transducer can also assume an upright neutral position. The three positions are shown in FIG. 4. The position of the speaker shown in solid lines is the position the speaker would be in when the headset is mounted on the right ear. When the user wishes to wear the device on his or her left ear, the user would pivot the speaker transducer about the axis 35 and put it into the leftmost position shown in FIG. 4. In this way, the headset can easily be used on either one of the user's ears.

Furthermore, the rotatable joint 33 also means that in each of the left and right positions, the speaker transducer can be moved up and down to adapt to the specific shape and anatomy of the user's ear.

In addition, as indicated by the dotted lines in FIG. 3 the frontal body portion 31 can be flexible and resilient to press the speaker transducer in a forward direction, i.e. against the entrance to the user's ear canal. It should be noted, that in the current embodiment, the frontal body portion is a solid flexible body. However, other forms of the frontal body could also be imagined, for example the frontal body portion could be made up of a number of rigid pieces connected together by flexible joints. Or the lower part of the frontal body portion could be flexible and the upper part stiff, or vice versa.

It should furthermore be noted, that when the headset shown in FIGS. 3 and 4 is mounted on the ear of the user, it is possible to arrange the speaker transducer such that it is very close to the ear canal without it being necessary for the speaker transducer to be in physical contact with the ear canal of the user. In this way, the headset is very comfortable to use, even after long periods. Furthermore, it should be noted that the speaker transducer is placed close to the ear canal, but it does not necessarily need to block the entire entrance to the ear canal as is the case with most prior art headsets. In this way, it is still possible for the user to hear the surrounding environment noises even though he or she is wearing the headset.

Another advantage of the headset as shown in FIGS. 3 and 4 is that the headset is very intuitive for the user to adjust and position on his or her ear. Due to the fact that there are very few adjustments, the device is very easy to operate. Furthermore, even though there are a reduced number of adjustments, the device can still be adjusted to fit many different types of ears comfortably.

Figure 5:
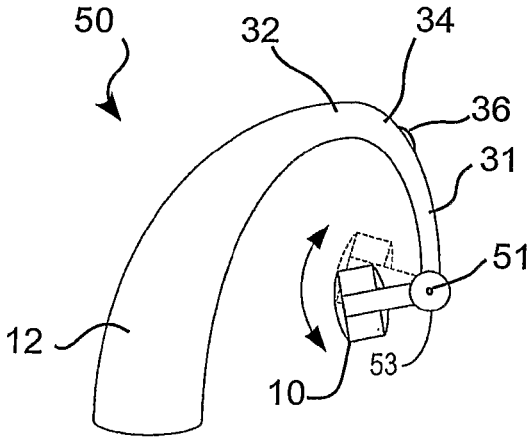
FIG. 5 is a right side view of a variant of the embodiment in FIGS. 3 and 4.

FIG. 5 shows a variant 50 of an OTE headset according to the current invention. Most of the features of the headset 50 are identical with the headset 31 of FIGS. 3 and 4, therefore the features in common won't be described again here. In this embodiment, the joint 53 between the speaker transducer and the frontal body portion 31 also allows an up and down movement of the speaker transducer. In the current embodiment, this is made possible by arranging the joint to be rotatable about an axis 51 which is perpendicular to a plane which is parallel to the side of the user's head when the device is carried by the user. Furthermore, if desired, the joint 53 can also allow the same movements as in FIGS. 3 and 4. The joint 53 could for example be a ball joint or similar multi degree of freedom joint.

Figure 6:
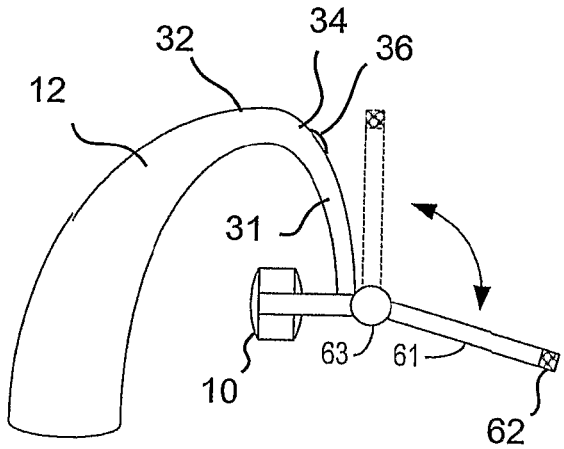
FIG. 6 is a right side view of another variant of the embodiment of FIGS. 3 and 4.

In FIG. 6 a microphone 62 on the end of an arm 61 extending from a joint 63 has been added to the headset. The arm is movable between a use position, where the microphone 62 extends in a forward direction towards the user's mouth, and a retracted position (shown in dotted line) where the headset takes up less space. The arm 61 can comprise two or more pieces within each other so that the pieces can be extended to a longer arm than the one shown. This is a sort of telescoping action. Furthermore, it should be noted that in quiet environments, the microphone can also be used in its retracted position. However, in noisy environments, the microphone can be moved to the extended position in order to better pick up the sound coming from the user's mouth.

It should be mentioned, that each of the joints and other movable interconnections can have means for retaining it in a position to which it is moved by the user. Such means can include friction or predefined click positions (ratchet mechanisms). Or the joints and moveable connections can include a spring that biases the joint or moveable connection in a predetermined direction, such as pressing the speaker transducer forward against the entrance to the user's ear canal.

It should be noted that all the above described embodiments have been related to OTE headsets for use together with mobile telephones, computers, etc. However, electroacoustic devices according to the current invention could also be used in other applications, for example as audio earphones, etc.

In the case that teachings of the current invention were applied to a set of stereo audio earphones, two similar devices would be made, one earpiece for the left ear and one earpiece for the right ear. It could then be imagined that the rotation of the speaker transducers about the axis as described above were restricted to rotation on one side of the median plane of the device. The left earpiece would restrict the speaker rotation such that it was always on the right side of the median plane and vice-versa, the right earpiece would restrict the speaker rotation such that it was always on the left side of the median plane of the device. In this way, the user would very easily see which device was the left earpiece and which was the right earpiece.

Furthermore, it should be noted that the first two embodiments described are not, as such, encompassed within the scope of the current claim set. However, it should be noted, that these two embodiments are devices having their own special features and they might be used as the basis for divisional applications in the future.

The invention claimed is:

1. An electroacoustic device comprising:

a rear body portion containing electronic circuits, and having a dimension and a shape that are configured to be carried by a human user behind and on a user's ear, the rear body portion comprising an upper end portion;

a frontal body portion comprising an upper end portion connected to the upper end portion of the rear body portion; and an electroacoustic speaker transducer connected to the frontal body portion, wherein the electroacoustic speaker is rotatable about an axis on a plane that is substantially parallel to a side of a head of the human user when the device is carried behind and on the user's ear, wherein the axis forms an angle to a horizontal plane of between +50° and −50° when the device is carried behind and on the user's ear, and wherein the electroacoustic speaker transducer is arrangeable in a sound transmitting relationship to a user ear canal when the device is carried behind and on the user's ear, wherein the axis is arranged such that the speaker transducer can be moved up and down to adapt to a specific shape and/or anatomy of the user ear, by rotating the speaker transducer about the axis, wherein the axis is arranged at a level of the user ear canal when the device is carried behind and on the user's ear, and wherein the axis is substantially horizontal.

2. An electroacoustic device according to claim 1, wherein a position of the electroacoustic speaker transducer in a forward-backward direction is adjustable.

3. An electroacoustic device according to claim 1, wherein the electroacoustic speaker transducer is rotatable about an axis that is substantially perpendicular to a plane that is substantially parallel to the side of the head of the human user when the device is carried behind and on the user's ear.

4. An electroacoustic device according to claim 1, further comprising a resilient element that is configured to bias the electroacoustic speaker transducer towards a preferred position.

5. An electroacoustic device according to claim 1, further comprising a microphone.

6. An electroacoustic device according to claim 5, further comprising an elongate member configured with the microphone arranged at a free end thereof.

7. An electroacoustic device according to claim 6, wherein the elongate member is moveable between a forwardly extended position that is closer to the user's mouth when the electroacoustic device is carried behind and on the user's ear and a retracted position that is farther from the user's mouth when the device is carried behind and on the user's ear.

8. An electroacoustic device according to claim 1, wherein the device is symmetrically adjustable relative to a median plane of the device, wherein the device is equally suitable behind and on a left ear and a right ear of the user.

9. An electroacoustic device according to claim 1, further comprising means for wirelessly communicating.

10. An electroacoustic device according to claim 1, wherein the axis forms an angle to a horizontal plane of between +30° and −30° when the device is carried behind and on the user's ear.

11. An electroacoustic device according to claim 1, wherein the axis forms an angle to a horizontal plane of between +15° and −15° when the device is carried behind and on the user's ear.

* * * * *